United States Patent [19]

Leitner et al.

[11] 4,124,065

[45] Nov. 7, 1978

[54] APPARATUS FOR CLEANING HEAT EXCHANGER TUBES

[75] Inventors: Gordon F. Leitner, Elm Grove; Fred G. Wiegratz, Wauwatosa, both of Wis.; John C. Cleaver, deceased, late of Milwaukee, Wis., by Harriet W. G. Cleaver, personal representative; by Laird C. Cleaver, personal representative; Lee Wolcott, Vice President, First Wisconsin Trust Company, personal representative, all of Milwaukee, Wis.

[73] Assignee: Water Services of America, Inc., Milwaukee, Wis.

[21] Appl. No.: 738,889

[22] Filed: Nov. 4, 1976

[51] Int. Cl.[2] ..... F28G 1/12

[52] U.S. Cl. ..... 165/95; 134/8; 134/22 C; 15/104.06 A

[58] Field of Search ..... 165/95, 94; 15/104.06 A; 134/6, 22 C; 285/22, 319; 220/306; 151/41-75; 24/213 R, 214

[56] References Cited

U.S. PATENT DOCUMENTS

| | | | |
|---|---|---|---|
| 2,529,420 | 11/1950 | Ramquist | 24/214 |
| 2,949,143 | 8/1960 | Shur | 151/69 |
| 3,432,383 | 3/1969 | Russell | 134/22 C |
| 3,473,961 | 10/1969 | Heeren et al. | 165/95 |

*Primary Examiner*—Charles J. Myhre
*Assistant Examiner*—Theophil W. Streule, Jr.
*Attorney, Agent, or Firm*—Fred Wiviott

[57] ABSTRACT

In a cleaning system for heat exchanger tubes each tube has a chamber at its end for capturing a tube cleaning element such as a brush that is subject to being propelled in opposite directions through the tube by reversing the direction of fluid flow therein. Novel means are provided for enabling access to the tube through the chamber for such purposes as replacing brushes and admitting a flaw detector to the tube.

29 Claims, 12 Drawing Figures

APPARATUS FOR CLEANING HEAT EXCHANGER TUBES

BACKGROUND OF THE INVENTION

This invention pertains to improvements in a chamber that is coupled to the end of a heat exchanger tube and is adapted to capture a brush which is propelled back and forth through a tube that is to be cleaned under the influence of fluid whose flow direction is reversible. Chambers having some of the features exclusive of the improvements described herein are shown and described in U.S. Pat. No. 3,319,710 dated May 16, 1967.

A common type of heat exchanger in which the new cleaning element capturing chambers may be used has a bundle of tubes fixed at opposite ends in headers. Typically, untreated cooling water flows through the interior of the tubes and exchanges heat with water or some other fluid on the outside of the tubes which is at a different temperature than the water flowing on the inside of the tubes. As is well known, if the water flowing through the tubes is untreated or inadequately treated for minimizing precipitation of minerals, a mineral deposit will gradually accumulate on the inside of the tubes. As taught in the cited patent, accumulation of mineral in the tubes can be inhibited by propelling a brush or other cleaning element through the tubes periodically to dislodge the mineral so it may be entrained in cooling fluid and carried away. The brush capturing devices are attached to the ends of the tubes. Heretofore, brush capturing chambers have been molded out of synthetic resin. The chambers have an integral tubular portion for being inserted in the end of a tube or in a coaxial hole in the header. The chambers are usually bonded or otherwise fastened in their receiving holes in such manner that any attempt to remove them results in their destruction. The brush or other cleaning element, of course, is placed in the chamber before it is inserted in its receiving hole. Occasions arise, however, when it is desirable to have clear access to the interior of the heat exchanger tubes such as for the purposes of replacing worn cleaning elements or admitting a probe for testing the integrity of the tube walls. Heretofore, the only way that this could be done was to break the chamber away and replace it with a new one when the test was completed.

SUMMARY OF THE INVENTION

A primary object of this invention is to provide cleaning element capturing chambers which enable convenient access to the interior of the chambers and to the interior of the tubes to which the chambers are coupled whereby the cleaning elements may be easily installed and replaced and other instrumentalities such as tube cleaning and testing instruments may be inserted in the tubes without interference by the chambers.

Further objects are to provide cleaning element capturing chambers that are easy and economical to manufacture, easy to install and remove, and adapted for supplanting prior types of chambers in existing tube installations.

How the foregoing and other objects of the invention are achieved will be evident in the course of the ensuing description of the illustrative embodiments of the invention in which reference is made to the accompanying drawing.

DESCRIPTION OF A PREFERRED EMBODIMENT

Figure 1:
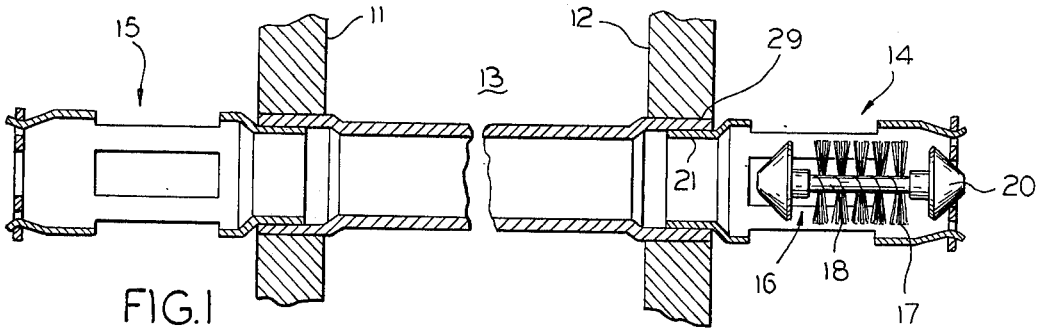
FIG. 1 is a longitudinal cross section through a typical heat exchanger tube mounted in fragmentarily shown tube sheets where the tube has a capturing chamber at each end and in one of which chambers there is a cleaning element of the brush type.

FIG. 1 illustrates a system incorporating one type of new cleaning element capturing device. In this Figure, a heat exchanger tube 10 is shown with its opposite ends sealed into tube sheets 11 and 12. The tube sheets may be considered the end walls of a container which has fluid inlet and outlet means, not shown, so that a fluid such as a refrigerant flowing over the outside of the tube in the space marked 13 will exchange heat with fluid flowing through the interior of tube 10. At each end of heat exchanger tube 10 there are cleaning element capturing devices which are generally designated by the reference numerals 14 and 15. In practice, the chambers project into individual water boxes, not shown, such that there is a flow path from one chamber to the other. In arrangements to which the new chamber designs apply, flow from water box to water box and, hence, through tube 10 is reversible.

In FIG. 1 a cleaning element in the form of a brush 16 resides in chamber 15. The brush has bristles 17 which are usually disposed spirally about a wire core 18 which has conically shaped caps 19 and 20 at its ends. Caps 20 are made of a material that does not absorb fluids such as plastic or metal. Bristles 17 may be made of wire or other suitable bristle material and they have a length which will cause them to brush the inside of the tube lightly when the cleaning element is propelled through tube. The cleaning elements could be soft sponge rubber balls, not shown, in place of brushes.

When fluid flow is from chamber 14 to 15, brush assembly 16 is constrained to remain in chamber 15. When the fluid flow direction is reversed as compared with the direction just mentioned, fluid flowing into tube 10 ahead of brush assembly 16 projects the brush tip into the tube after which the flow of water into tube 10 propels the brush assembly through the tube to chamber 14 where it is captured. The concept of tube cleaning with propelled brushes is discussed in previously cited U.S. Pat. No. 3,319,710 to which reference may be made for details on construction and applications. Several different kinds of brush assemblies are also described in the cited patent wherein it is shown that they may be provided with soft rings of a material such as foam rubber mounted behind caps 19 and 20 for augmenting the cleaning and wiping action of the brushes as they are propelled through tube 10.

In accordance with prior practice, brush capturing chambers were made of plastic and were usually fastened in the headers endwise of the tubes with cement. The plastic chambers were molded without any separable parts. There was no practical way of removing the brushes for replacement nor was there a way for introducing any instrumentality through the chambers into the tubes. This is a handicap because modern maintenance practice for heat exchangers involves complete cleaning of the tubes periodically in preparation for using electronic testing devices for detecting potential leaks in the tubes, their joints and supports. The electronic sensing devices detect pitting, stress corrosion cracks and erosion in the tubes which are precursors of tube failure. One commercially available electronic inspection device, not shown, comprises a probe on one end of a cable which is used for pushing the probe through the tubes and for conducting electric signals from the probe. The probe develops eddy currents in the tubes which vary in accordance with the variations in tube integrity and these variations result in the electric signals which are analyzed with suitable electronic instruments.

Figure 2:
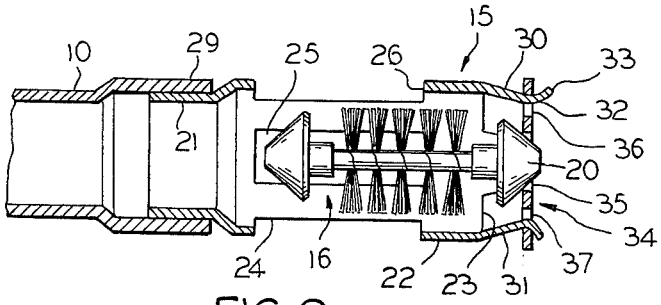
FIG. 2 is an enlarged longitudinal cross section of the cleaning element capturing chamber shown in the preceding figure and made in accordance with the invention.
Figure 3:
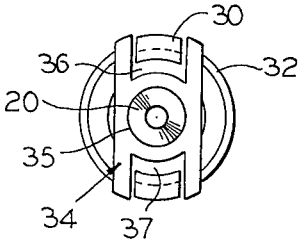
FIG. 3 is a view of the right end of the device shown in FIG. 2.

One embodiment of a cleaning element capturing chamber which, in accordance with the invention, is distinguished by having retainer means for maintaining the cleaning element in a captured state but which is removable to permit access to the interior of the chamber and to the tube to be cleaned, is shown in FIGS. 2–5 which will now be discussed. In FIG. 2, the new chamber 15 is generally cylindrical and may be formed of noncorrosive thin sheet metal. As shown in FIGS. 2–5, the capturing chamber 15 has been formed into a cylindrical shell from a sheet metal blank in which suitable perforations are made. Chamber 15 has one end portion 21 formed as a tube and another portion 22 formed generally cylindrically such as to define an axial opening 23. A portion 24 of the chamber intermediate end portions 21 and 22 is provided with several longitudinal slots or openings such as 25 and 26 which along with opening 23 permit unrestricted fluid flow through the chamber to and from tube 10.

Figure 4:
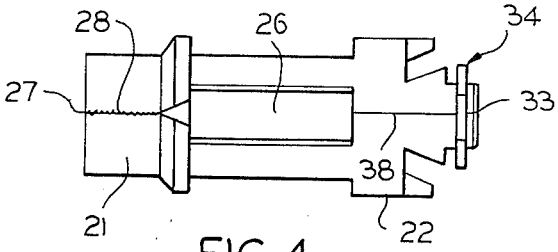
FIG. 4 is a plan view of the brush capturing chamber and retainer which is shown in FIGS. 2 and 3.

As is evident in FIG. 4, tubular portion 21 of chamber 15 has a seam which preferably has a weld 28. In accordance with the invention, the outside diameter of tubular portion 21 is about equal to the inside diameter of the flared end 29 of tube 10 as can be seen in FIG. 2. A feature of the invention is that tubular portion 21 is secured in the cylindrical opening in flared end portion 29 of the tube by expanding the tubular portion 21. This is done with a commercially available device, not shown, comprised of rollers having parallel axes and which are pressed into tubular portion 21 while rotating to effect expansion. Thus, as compared with prior practice, the cleaning element capturing chambers may be installed without cementing or other interlocking means being required.

Another method of installing the chambers 15 is to first reroll the interior of the flared portion 29 of the tubes to create one or more internal annular grooves and providing the exterior of the tubular portion 21 with one or more annular ridges, not shown, so that the chamber may be installed with the ridge or ridges mating with the grooves. Care must be taken to avoid overstressing and weakening the tube ends as a result of double rolling.

Still another method of installing the chambers is to have the tubes 10 extend outwardly of the tube sheets 11 and 12 and have chambers sized to fit on the extending tube ends.

Extending integrally from cylindrical end portion 22 of the chamber body in cantilever fashion are a pair of spring members 30 and 31 which are for releasably engaging with a retainer. Each of these spring members has a radially inwardly direction indentation 32 which causes a shoulder or stop 33 to be defined. Spring members 30 and 31 are for engaging with or being engaged by a cleaning element retaining device which is generally designated by the reference numeral 34. In this embodiment, retainer 34 is a flat member having a central opening 35 and a pair of radially spaced apart openings 36 and 37. It should be evident that to install retainer 34 it is only necessary to press spring members 30 and 31 toward each other so that the shoulders 33 pass through openings 36 and 37 in the retainer. After that, spring members 30 and 31 are released and deflect radially outwardly to effect gripping of the retainer means 34.

Note in FIG. 4 that cylindrical portion 22 of the chamber is split by a seam 38 extending longitudinally such that one of the spring members 30 is comprised of two identical halves. Seam 38 need not be welded to impart rigidity to the outer end of chamber 15. The seam is constrained against separating or spreading by the small difference between the width of spring member 30 and the width of hole 36 in retainer 34.

Figure 5:
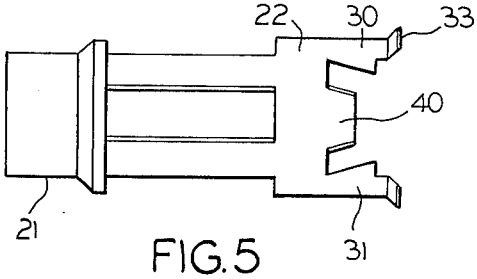
FIG. 5 shows the device of FIG. 4 rotated 90° and with the retainer removed.

The FIG. 5 side view shows that there is an axially extending portion or wall 40 on the chamber for stabilizing and centering the cleaning brush 16 when it is captured. The space between extending portion 40 and retainer 34 provides an additional passageway for fluid to ingress and egress relative to the chamber.

Figure 6:
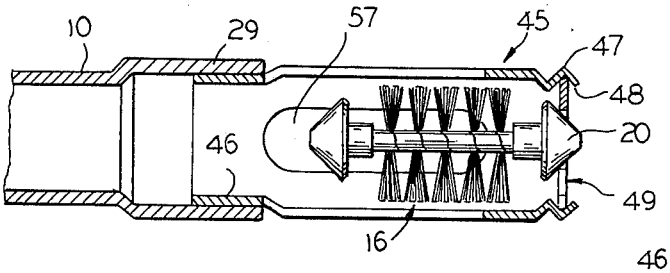
FIGS. 6 and 7 are, respectively, longitudinal cross section and right end views of another embodiment of the cleaning element capturing chamber.
Figure 7:
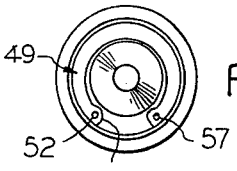
Figure 8:
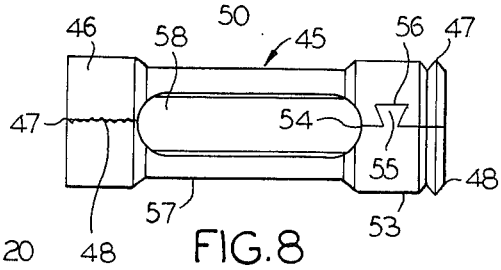
FIG. 8 is a plan view of the chamber illustrated in FIGS. 6 and 7 with the cleaning element removed.

FIGS. 6–8 show an alternative embodiment of the brush capturing chamber with means for gaining access to its interior. This embodiment comprises a cylindrical body 45 which has been formed into a cylinder from a suitably perforated sheet metal blank. The chamber has a tubular portion 46 at one end that has a seam 47 which is joined by a weld 48. Tubular portion 46, similar to tubular portion 21 in the above discussed embodiment, fits snuggly into the cylindrical hole in flared portion 29 of tube 10. The tubular insertable portion 46 of the chamber is subject to being expanded or swaged with a rotating roller device as described in connection with the preceding embodiment.

At the end of chamber 45, remote from tubular portion 46, the chamber is formed with a shoulder 47 that provides an internal annular recess 48. The recess is for engaging with a retainer means that is generally designated by the reference numeral 49. This retainer is essentially a commercially available snap ring which, as can be seen in FIG. 7, has a gap 50 between its open ends. The ends each have holes 51 and 52 which are engageable with a tool, not shown, for pressing the ends toward each other to thereby reduce the diameter of the ring 49. This permits the ring to be introduced into annular recess 48 for the purpose of retaining brush assembly 16 in chamber 45. As can be seen in FIG. 8, chamber 45 has a cylindrical portion 53 adjacent internal recess 48 in which there is a seam 54 that is secured against spreading with a dove-tail tab 55 engaging in a complementarily shaped slot 56. One may see also in FIG. 8 that the body of shell chamber 45 intermediate end portions 46 and 53 is provided with several circumferentially spaced longitudinally disposed slots or openings such as 57 and 58 so there may be an unimpeded fluid flow path through the chamber to tube 10. It will be evident in the FIGS. 6–8 embodiment that clear access to the interior of chamber 45 is obtainable by removal of snap ring 49 such as for the purpose of passing a testing probe axially of the chamber and the tube or for allowing withdrawal of brush 16 when desired.

Figure 9:
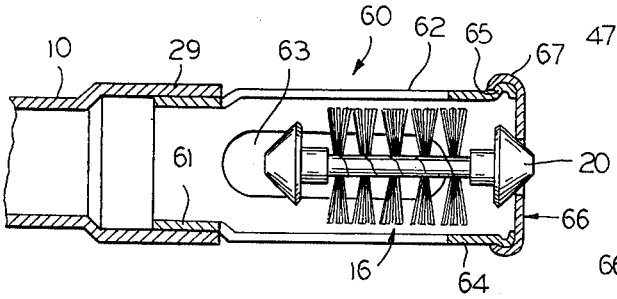
FIG. 9 is a longitudinal cross sectional view of another embodiment of a cleaning element capturing device incorporating the features of the invention.
Figure 10:
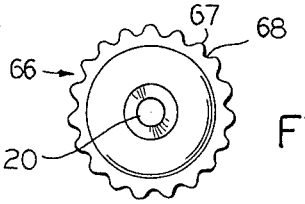
FIG. 10 is a plan view of a cap type retainer that cooperates with the chamber illustrated in FIG. 9.

FIGS. 9 and 10 illustrate another alternative embodiment of the invention. The chamber body 60 is made of thin sheet metal formed cylindrically with an integral cylindrical end portion 61 which can be expanded as described above for fastening the brush capturing chamber in a correspondingly shaped opening in a tube header or tube. The body or shell has several longitudinal openings such as 62 and 63 which, in this design, are the main passages for fluid to flow in and out of tube 10. The chamber body has a cylindrical end portion 64 whose margin is formed with a radially extending shoulder 65. The shoulder 65 is preferably a continuous annulus. The shoulder is shaped for receiving a cleaning element retainer means which is generally designated by the reference number 66. Retainer 66 is essentially a cap having an annular rim 67. As can be seen in FIG. 10, the interior of rim 67 is provided with a plurality of inwardly projecting protuberances 68. The circular cap 66 has the appearance and properties of the well known crown cap which is used to close bottles. In this case, however, cap 67 is simply pressed onto annular shoulder 65 of chamber 60 so as to effect a friction fit therewith. No special tool is required to install the cap. It can be pryed off of the chamber body with any suitable instrument.

Figure 11:
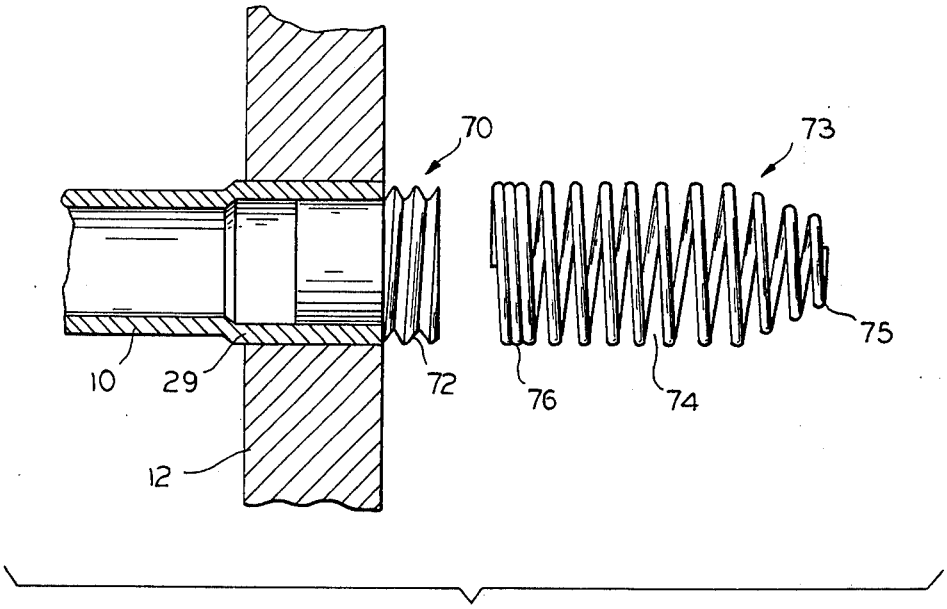
FIG. 11 shows another alternative embodiment of a cleaning element capturing chamber in disassembled form, partly in section, with the cleaning element omitted.
Figure 12:
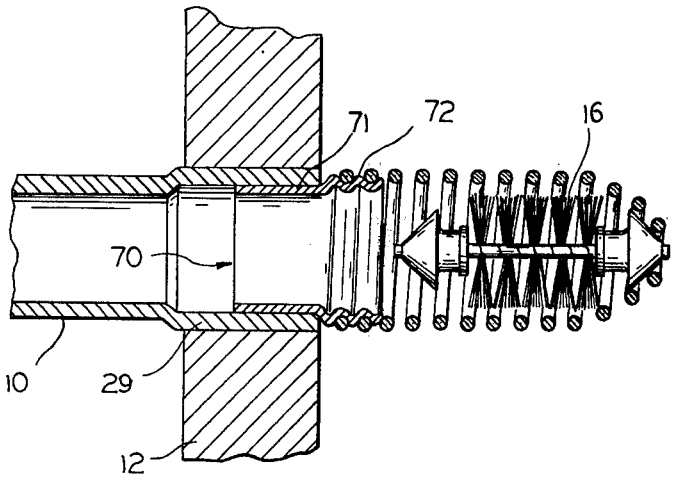
FIG. 12 shows the device of FIG. 11 as it appears when assembled.

FIGS. 11 and 12 illustrates still another alternative embodiment of the invention. In this, as in the previous embodiments, the heat exchange tube 10 is secured in the tube sheet 12 by expanding its end 29 with a conventional roller expander, not shown. As can be seen in FIG. 11, a thin walled sleeve means, which for brevity is called a thimble 70, is installed in the end 29 of the tube 10. The thimble has a tubular portion 71 which may be expanded with a roller expander into leak proof engagement with the interior of tube end 29. A thread 72 is formed on one end of thimble 70 with a thread roller, not shown. A cleaning element capturing chamber or cage 73 comprised of a helically wound wire defining a flow-through enclosure having one fully open end is adapted for being screwed onto thread 72 after the tube cleaning brush 16 has been inserted in the cage as can be seen in FIG. 12.

Cage 73, in this example, is wound as a coil with a relatively wide pitch central section 74 of constant diameter and its outer end is wound with a continuously diminishing diameter to form an end enclosure 75 which prohibits brush 16 from emerging from the cage. A few turns 76 are wound with a pitch that is the same as the pitch of rolled thread 72 on thimble 70. Thus, cage 73 may be screwed on and off of thimble 70 by hand. The internal diameter of the cage including turns 76 is sufficiently large to permit the cleaning element to transit freely between the cage and the tube.

FIG. 12 shows wire cage 73 installed on thimble 70 with a cleaning element or brush assembly 16 in place. It will be evident that when cage 73 is removed clear access is provided for admitting a test probe or a tube cleaner to the interior of tube 10 through thimble 70. When the cage is attached to the thimble, as it is during normal operation, the spacing between the wire turns provides a substantial amount of passageway for water to flow in and out of the heat exchange tube without restriction.

Under proper circumstances the wire wound cage or chamber 73 may be inserted directly into expanded end 29 of tube 10 instead of coupling the cage to the tube with thimble 70. For instance, a thread, not shown, may be rolled or otherwise formed interiorly of tube end 29 and the closely wound similarly pitched end 76 of the cage may be screwed into the internal thread directly. Care must be taken, however, not to overstress the tube by forming an internal thread that is unnecessarily deep but if the number of threads are limited to one or a fraction more they will be near the end of the tube and there will still be along seal between the tube sheet 12 and exterior of tube 29 which is without thread and, hence, not subject to overstressing.

Although several embodiments of the new cleaning element catching chamber device have been described in considerable detail, such description is intended to be illustrative rather than limiting, for the invention may be variously embodied and is to be limited only by interpretation of the claims which follow.

What is claimed is:

1. A cleaning element catching chamber comprising a hollow body having a first open ended portion for communication with a heat exchanger tube and a second end portion longitudinally displaced from said first portion, said body defining an interior space for accommodating a tube cleaning element that is adapted for being propelled through said tube under the influence of fluid, a retainer, coupling means disposed adjacent the second end portion of said body and including a plurality of spaced apart resilient members each constructed and arranged to resiliently engage said retainer for supporting the same at said second end portion, said retainer being constructed and arranged when mounted on the second end portion to present an obstruction to said cleaning element against removal from said body, said resilient members being movable out of engagement with said retainer to permit the removal thereof from said body enabling access to the interior thereof and said tube.

2. The combination set forth in claim 1 wherein said spring members extend from said body in cantilever fashion at said second end portion for developing a biasing force when said spring members are deflected, said retainer having means for engaging said spring members, respectively, when they are deflected such that said retainer will be secured to said spring members in the path of said cleaning element under the influence of said biasing force.

3. The combination set forth in claim 1 wherein said spring members extend in cantilever fashion generally longitudinally of said body at said second end portion, said retainer having means for being releasably engaged between said spring members, respectively.

4. The combination set forth in claim 1 wherein said spring members extend in cantilever fashion from said body generally longitudinally thereof at said second end portion, said spring members having the property of developing a biasing force when in a deflected state that tends to restore them to an undeflected state, said retainer having means for being engaged by said spring members when in a deflected state such that said spring members will hold said retainer in obstructing relation with respect to said cleaning element under the influence of said biasing force when said spring members tend to return to an undeflected state.

5. The combination set forth in claim 4 wherein said retainer has spaced apart holes for receiving said spring members, respectively, when they are deflected, said spring members having shoulder means adjacent their ends for stopping said retainer means against removal when said spring members are substantially undeflected.

6. The combination set forth in claim 4 wherein said first open ended portion comprises tubular means having a longitudinally extending closed seam, said second end of said body having a longitudinally extending openable seam, said retainer having holes corresponding with said spring means for being engaged by said spring members, said holes in said retainer being sized to prevent said openable seam from opening when engaged with said spring members.

7. The device as in claim 1 wherein:

said means for engaging and disengaging said retainer means comprises means for defining an internal recess in said other end portion of said body, said retainer means comprising a ring of spring material having a gap therein and being insertable in said recess to obstruct removal of said cleaning element and removable from said recess to permit access through said chamber to said tube.

8. The device as in claim 1 wherein:

said means for engaging and disengaging with said retainer means comprises an annular portion on said other end portion of said body, said retainer means comprising cap means for frictionally engaging with said annular portion to thereby retain said cleaning element in said chamber.

9. The device as in claim 8 wherein said cap means has at least one hole through it for enabling fluid flow through it.

10. The device as in claim 1 wherein:

said means for engaging and disengaging with said retainer means comprises means for defining annular shoulder means on said other end portion of said body, said retainer means comprising a cap means having a circular rim with circumferentially spaced radially inwardly extending protuberances for engaging said cap means with said shoulder means.

11. A cleaning element catching chamber for use in cooperation with a tube that is subject to being cleaned internally, comprising:

a hollow generally cylindrical thin walled member and having first and second openings at opposite first and second ends, respectively, a portion of said member intermediate said ends defining an interior space for accommodating a tube cleaning element that is adapted for being propelled through said first opening to and from the interior of said tube that is to be cleaned, said portion having at least one aperture for fluid to pass between the interior and exterior thereof, a radially expandable tubular portion at said one end of said member defining said first opening, a retainer and a plurality of spaced apart coupling members at said second end of said member, said retainer including means releasably engageable with said members for securing said retainer to said cylindrical member, engagement of said retainer effecting obstruction of said second opening to thereby enable capture of said cleaning element by said chamber and disengagement of said retainer removing said obstruction to thereby enable introduction of an instrumentality through the interior of said chamber to said tube.

12. The combination set forth in claim 11 wherein said coupling members comprise spaced apart spring members extending from said cylindrical member in cantilever fashion for developing a biasing force when said spring members are deflected, said retainer having means for engaging with said spring members, respectively, when they are deflected such that said retainer will be secured to said spring members across said second end opening under the influence of said biasing force.

13. The combination set forth in claim 11 wherein said coupling members comprise spaced apart deflectable spring means extending in cantilever fashion generally longitudinally of said cylindrical member, said retainer having spring member engaging portions for being releasably engaged by said spring members, respectively.

14. The combination set forth in claim 11 wherein said coupling members comprise spaced apart spring members extending in cantilever fashion from said cylindrical member at said second end, said spring members having the property of developing a biasing force when in a deflected state that tends to restore them to an undeflected state, said retainer having means for being engaged by said spring members when in a deflected state such that said spring members will hold said retainer in obstructing relation with respect to said cleaning element under the influence of said biasing force.

15. The combination set forth in claim 14 wherein said retainer has spaced apart holes for receiving said spring members, respectively, when they are deflected, said spring members having shoulder means adjacent their ends for stopping said retainer against removal when said spring members are substantially undeflected.

16. The device as in claim 14 wherein said cylindrical member has a longitudinally extending seam at said second end, said retainer having holes corresponding with said spring members for being engaged by said spring members, said holes being sized to prevent said seam from opening when said spring members are engaged with said retainer.

17. The device as in claim 11 wherein:

said means for engaging and disengaging said retainer means comprises means for defining an internal recess in said second end of said cylindrical member.

18. The device as in claim 11 wherein:

said means for engaging said retain means comprises an annular region at said second end of said cylindrical member, said retainer means comprising cap means having an internal size substantially equal to the size of said annular region for enabling said cap means to frictionally engage with said annular region.

19. The device as in claim 18 wherein said cap means has at least one hole through it for enabling fluid flow therethrough.

20. The device as in claim 11 wherein:

said means for engaging and disengaging said retainer means comprises means for defining annular shoulder means on said second end of said cylindrical means, said retainer means comprising a cap member having a circular rim with circumferentially spaced radially inwardly extending protuberances for engaging said cap means with said shoulder means.

21. For use in apparatus in which a cleaning element is passed through a heat exchanger tube for cleaning the interior of the tube; a cleaning element capturing means comprising:

a wire cage constructed and arranged for being coupled to an end of said tube, said cage having an opening for leading to said tube which opening is sufficiently large for said cleaning element to translate between the interior of said cage and said tube.

22. For use in apparatus in which a cleaning element is passed through a heat exchanger tube for cleaning the interior of the tube; cleaning element capturing means adapted to couple with a threaded element that provides for fluid communication with said tube, said capturing means comprising:

a helical coil comprised of a plurality of turns defining an interior space for accommodating said cleaning element and having open space between at least some of said turns, and at least one turn at a first end of said coil having a pitch complementary to the pitch of the thread of said threaded element for enabling said coil to be threadingly engaged with and disengaged from said threaded element.

23. The device as in claim 22 wherein turns at a second end of said coil are progressively reduced in diameter for prohibiting said cleaning element from exiting from said second end.

24. The device as in claim 23 wherein said turns at said first end and turns between said first end and second end have substantially constant diameter.

25. The device as in claim 22 wherein the pitch of said turns at said first end is less than the pitch of other of said turns.

26. The device as in claim 22 wherein said at least one turn at said first end has an outside diameter of such size as to enable it to be turned into the inside of said threaded element.

27. A cleaning element capturing means for use in apparatus including a heat exchanger tube and a cleaning element which is adapted for translating through the tube to clean it, said means comprising:

a thin walled cylindrical sleeve means having a first cylindrical portion for fitting tightly in an end of said tube and a second coaxial cylindrical portion which is provided with a thread having a predetermined pitch, coil means comprised of first and second end turns and turns intermediate said end turns, said first end turns having substantially the same diameter and pitch as said thread in said sleeve means to enable said first end turns to be screwed on and off of said sleeve means, the inside diameter of said first end turns being sufficiently great to permit said cleaning element to transit between said tube and the interior of said coil means.

28. The means as in claim 27 wherein at least one of said turns at said second end is disposed across said coil to prevent said cleaning element from escaping therefrom.

29. The means as in claim 27 wherein said turns at said second end are reduced progressively in diameter in a direction away from said first end to thereby prevent said cleaning element from escaping from said coil.

* * * * *

UNITED STATES PATENT AND TRADEMARK OFFICE

CERTIFICATE OF CORRECTION

PATENT NO. : 4,124,065

DATED : November 7, 1978

INVENTOR(S) : Gordon F. Leitner, et al

It is certified that error appears in the above-identified patent and that said Letters Patent are hereby corrected as shown below:

Claim 2, line 2,4,5, and 7, "spring" should read --resilient--.
Claim 3, lines 2 and 5, "spring" should read --resilient--.
Claim 4, lines 2, 4, 7, 8 and 11, "spring" should read --resilient--.
Claim 5, lines 2, 4, and 6, "spring" should read --resilient--; line 5, cancel "means".
Claim 6, line 4, after "end" insert --portion--; line 6, "spring means" should read --resilient members- line 7 and 9, "spring should read --resilient--.
Claim 7, lines 3 and 5, cancel "means".
Claim 8, lines 3 and 5, cancel "means".
Claim 10, line 3(1st occurrence) cancel "means". line 6, cancel "means".
Claim 11, line 13, cancel "thereof" insert --of said member--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*